US007571959B2

(12) United States Patent
Griepentrog

(10) Patent No.: US 7,571,959 B2
(45) Date of Patent: Aug. 11, 2009

(54) STUDENT DESK

(75) Inventor: Dennis G. Griepentrog, DePere, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 10/598,021

(22) PCT Filed: Mar. 23, 2005

(86) PCT No.: PCT/US2005/009825

§ 371 (c)(1),
(2), (4) Date: Aug. 16, 2006

(87) PCT Pub. No.: WO2005/096795

PCT Pub. Date: Oct. 20, 2005

(65) Prior Publication Data

US 2007/0182222 A1 Aug. 9, 2007

Related U.S. Application Data

(60) Provisional application No. 60/557,138, filed on Mar. 26, 2004.

(51) Int. Cl.

| | |
|---|---|
| ***A47B 39/00*** | (2006.01) |
| ***A47B 39/02*** | (2006.01) |
| ***A47C 83/02*** | (2006.01) |
| ***B60B 33/00*** | (2006.01) |

(52) U.S. Cl. ..... 297/172; 297/170; 297/183.7; 16/35 R; 16/40; 16/42 R; 16/42 T

(58) Field of Classification Search ..... 297/170, 297/172, 183.7; 248/129; 16/42 T, 42 R, 16/18 R, 45, 40, 35 R
See application file for complete search history.

(56) References Cited

U.S. PATENT DOCUMENTS

| | | | | |
|---|---|---|---|---|
| 367,037 | A * | 7/1887 | Speakman et al. | 297/172 |
| 869,472 | A * | 10/1907 | Agnew | 297/172 X |
| 929,302 | A * | 7/1909 | Hanlon | 297/183.7 X |
| 1,023,620 | A * | 4/1912 | Burge | 297/172 X |
| 1,195,627 | A * | 8/1916 | Thum | 297/172 |
| 1,454,565 | A | 5/1923 | Sanford | |
| 1,768,427 | A * | 6/1930 | Stevens | 297/172 X |
| 1,883,322 | A | 10/1932 | Abbott | |

(Continued)

FOREIGN PATENT DOCUMENTS

| | | | | |
|---|---|---|---|---|
| EP | 252274 A2 * | 1/1988 | | 297/152 |

*Primary Examiner*—Rodney B White
(74) *Attorney, Agent, or Firm*—Andrus, Sceales, Starke & Sawall, LLP

(57) ABSTRACT

A student desk includes a base that supports a seat and a worksurface. The base includes transverse front and rear base members, with a central base member extending therebetween. A worksurface support and a seat support are mounted to and extend upwardly from the base, and the worksurface and seat are mounted to the worksurface and seat supports, respectively, so as to be adjustable in elevation. Casters are mounted to the front and rear transverse base members to facilitate movement of the desk on a support surface such as a floor. Certain of the casters may be constructed so as to lock in position when the desk is occupied. The seat includes a handle area, so that the desk can be quickly and easily repositioned in a classroom with minimal effort.

5 Claims, 5 Drawing Sheets

U.S. PATENT DOCUMENTS 1,884,497 A * 10/1932 Abbott ..... 297/172 X
1,929,551 A * 10/1933 Hamilton ..... 297/172 X
1,970,874 A 8/1934 Yawman
2,023,761 A * 12/1935 Drummey ..... 297/172
2,102,261 A * 12/1937 Fotre ..... 297/172 X
2,168,910 A 8/1939 Merrill
2,296,705 A * 9/1942 Childress ..... 16/40 X
2,439,322 A * 4/1948 Thaden ..... 297/183.7 X
2,470,834 A * 5/1949 Peltier ..... 297/183.7 X
2,536,157 A * 1/1951 Campanelli ..... 297/183.7 X
2,555,566 A * 6/1951 Bleck ..... 297/183.7 X
2,579,606 A * 12/1951 Oom et al. ..... 297/170 X
2,664,147 A 12/1953 O'Keefe et al.
2,673,595 A * 3/1954 Kump, Jr. ..... 297/172
2,716,440 A 8/1955 Silverman
2,732,007 A 1/1956 MacWhirter
2,747,564 A * 5/1956 Chapman et al. ..... 297/183.7 X
2,885,720 A * 5/1959 Seeberger ..... 16/35 R X
2,921,623 A * 1/1960 Humphries et al. ..... 297/172 X
2,942,290 A * 6/1960 Segal ..... 16/35 R
3,025,930 A * 3/1962 Segal ..... 16/35 R X
3,349,425 A * 10/1967 Reabelos ..... 16/44
4,560,200 A * 12/1985 Giannelli et al. ..... 297/172 X
4,632,410 A 12/1986 Bainbridge et al.
4,700,430 A * 10/1987 Raftery ..... 16/42 R X
4,821,369 A * 4/1989 Daniels ..... 16/35 R
5,259,088 A * 11/1993 Yang ..... 16/47
5,355,550 A * 10/1994 Yang ..... 16/35 R X
5,537,715 A * 7/1996 Yang ..... 16/35 R
5,542,746 A 8/1996 Bujaryn
5,617,934 A * 4/1997 Yang ..... 16/35 R
5,697,668 A 12/1997 Chao
5,749,121 A * 5/1998 Loescher ..... 16/42 T
6,269,578 B1 * 8/2001 Callegari ..... 297/172 X
6,419,319 B1 * 7/2002 Sakurai ..... 297/344.12
6,439,657 B1 8/2002 Tholkes
6,473,935 B1 * 11/2002 Cherukuri ..... 16/42 R X
6,776,452 B2 * 8/2004 Onishi ..... 297/170
7,134,719 B2 * 11/2006 Moglin et al. ..... 297/170 X
2005/0104421 A1 * 5/2005 Astle et al. ..... 297/183.7

* cited by examiner

FiG. 4
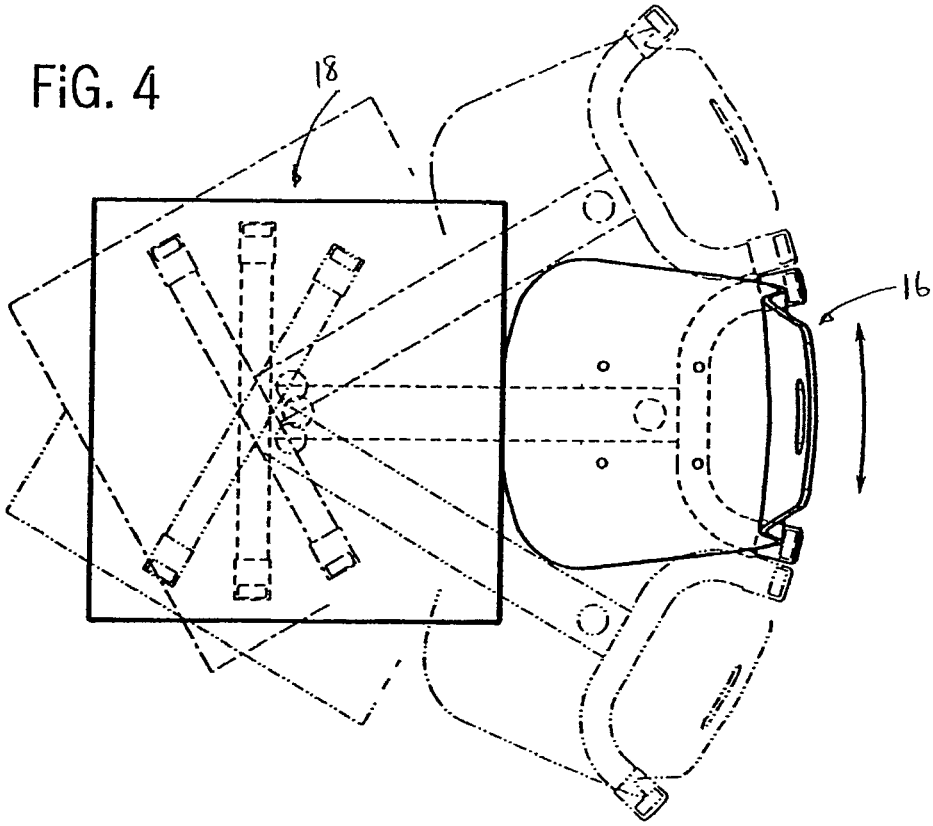
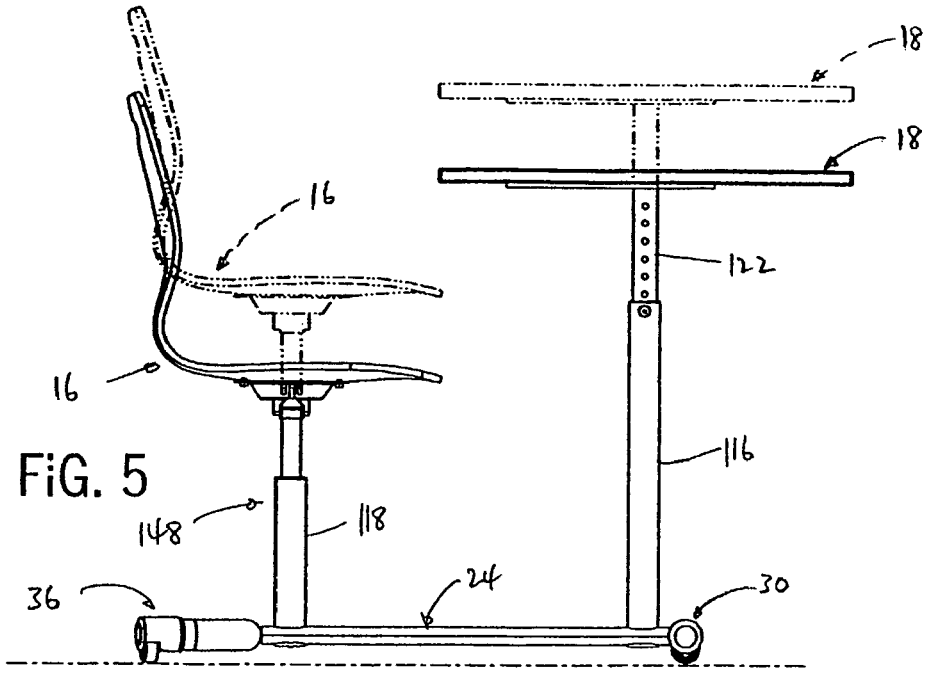
FiG. 5

STUDENT DESK

CROSS-REFERENCE TO RELATED APPLICATION

This application claims the benefit of U.S. Provisional Application Ser. No. 60/557,138, filed Mar. 26, 2004.

BACKGROUND AND SUMMARY OF THE INVENTION

This invention relates to classroom furniture in the nature of a student desk.

Conventional student desks include a base that supports a worksurface as well as a seat. Typically, student desks are arranged in a row and column configuration within a classroom. In order to provide collaborative learning, desks can be arranged in clusters in which the worksurfaces of several desks are positioned together and the desk seats are positioned so that the students face each other. Altering the arrangement of the desk within a classroom is often noisy and disruptive, since desks are typically provided with static glides that are not well suited for providing movement of the desks. Such rearrangement of desks can also result in the floor surface being scratched and marred by the desk glides. In addition, the typical construction of student desks makes the desks unwieldy to move when the desks are being rearranged within the classroom.

It is an object of the present invention to provide a student desk that is particularly well suited for use in classrooms in which the desks are movable to different configurations or arrangements within the classroom. It is another object of the invention to provide such a desk which includes adjustment features for adjusting the height of the seat and the worksurface, to accommodate users of different sizes. It is a further object of the invention to provide such a desk which provides ample leg room for the user. Yet another object of the invention is to provide such a desk which is quickly and easily movable from one location to another, yet which is positively maintained in a desired position when the desk is occupied. Yet another object of the invention is to provide such a desk which is easy to handle to facilitate movement of the desk from one position to another.

In accordance with the present invention, a student desk includes a base that is adapted to be supported on a support surface such as a floor. The base includes a front roller arrangement and a rear roller arrangement. An upstanding worksurface support extends upwardly from a forward area of the base, and an upstanding seat support extends upwardly from a rear area of the base. A worksurface is secured to and supported by the worksurface support, and a seat is secured to and supported by the seat support. In a preferred embodiment, the worksurface is engaged with the worksurface Support via an adjustable height worksurface mounting arrangement, which enables the height of the worksurface to be adjusted relative to the support surface. The seat is engaged with the seat support via an adjustable height seat mounting arrangement, which enables the height of the seat to be adjusted relative to the support surface.

The base of the desk preferably includes transversely extending front and rear base members, which are secured to a central axial base member. In a preferred form, the central axial base member and the front and rear transverse base members lie in a common plane that is parallel to the plane of the support surface. The base includes rollers that engage the support surface, to provide easy and quiet movement of the desk on the support surface from one location to another. The rollers may be in the form of casters that are mounted to the ends of the front transverse base member and to the ends of the rear transverse base member. In a preferred form, the rear casters are spring-biased locking casters, which include rollers that are prevented from rotating when a user is sitting on the seat of the desk. In this manner, the position of the desk is maintained when the desk is occupied, and the desk can be quickly and easily moved from one location to another when the desk is unoccupied. In a preferred embodiment, the seat of the desk includes a back which is provided with a handle that can be grasped by a user in order to facilitate movement of the desk from one location to another on the support surface.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 4 is a top plan view of the student desk of FIGS. 1 and 2;

FIG. 5 is a side elevation view of the student desk of FIGS. 1 and 2;

DETAILED DESCRIPTION OF THE INVENTION

Figure 1:
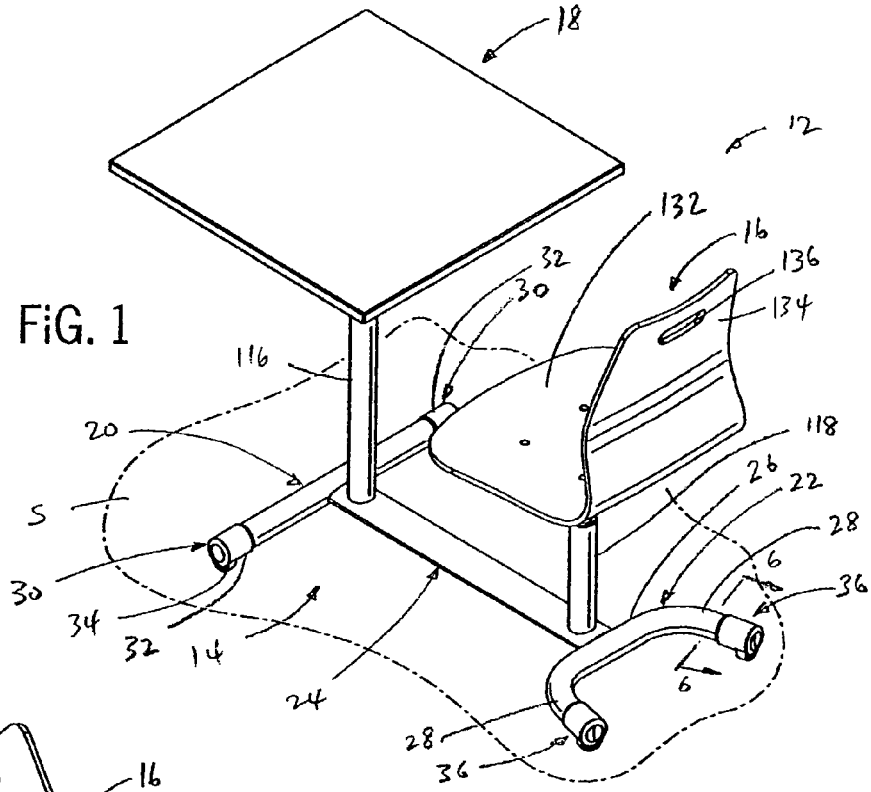
FIG. 1 is a top isometric view of a student desk in accordance with the present invention.
Figure 2:
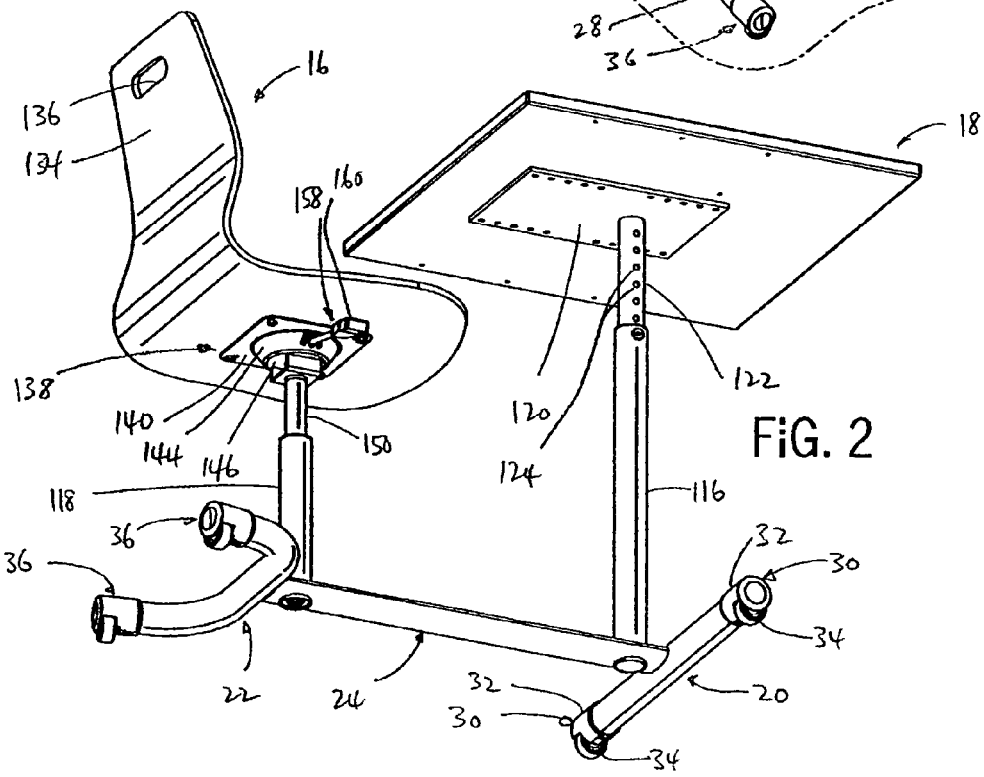
FIG. 2 is a bottom isometric view of the student desk of FIG. 1.
Figure 3:
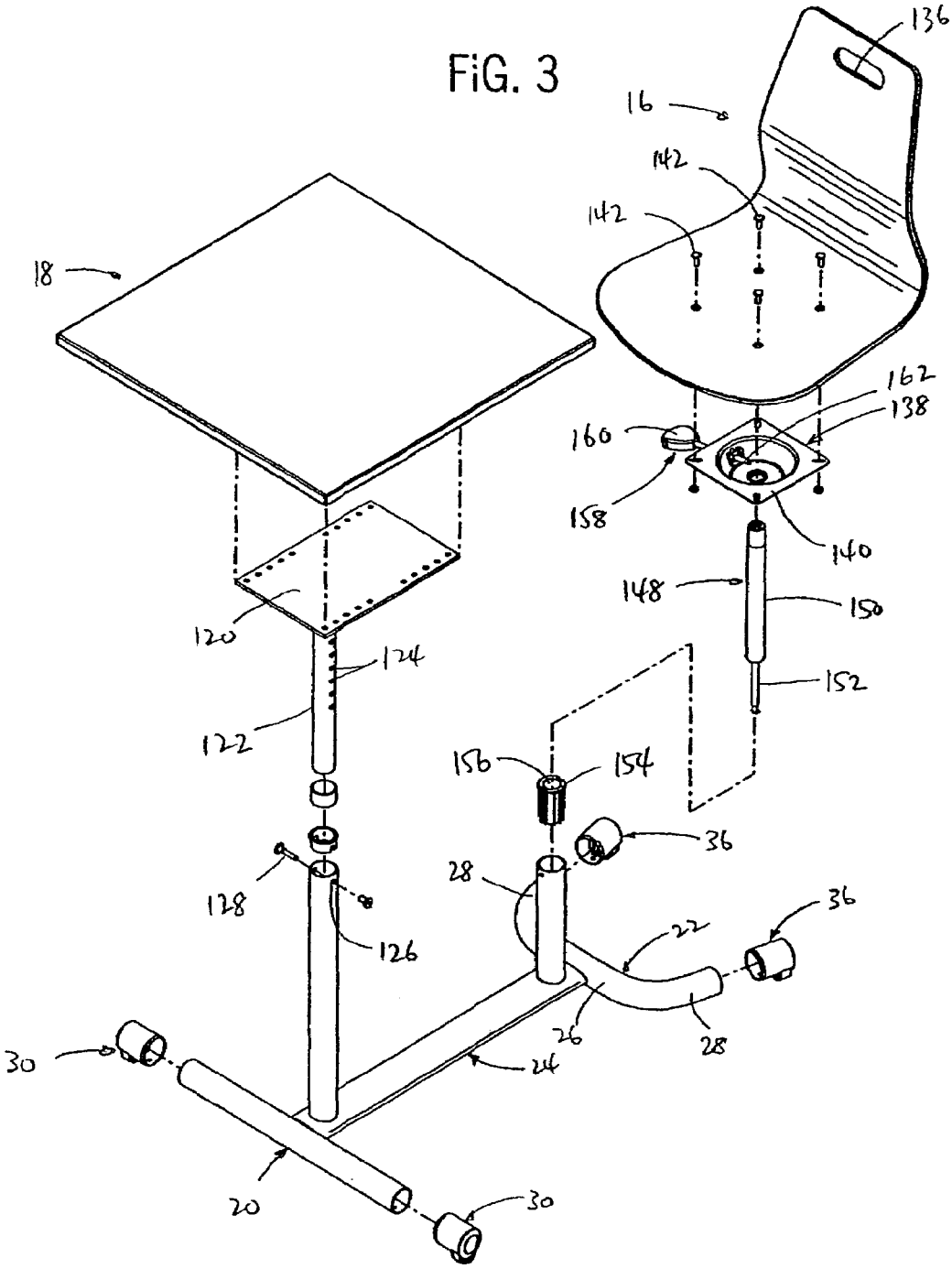
FIG. 3 is an exploded isometric view of the student desk of FIGS. 1 and 2.

Referring to FIGS. 1 and 2, a student desk 12 in accordance with the present invention generally includes a base 14, a seat 16 and a worksurface 18. Desk 12 is adapted to be supported on a support surface S such as a floor. In a manner to be explained, desk 12 is configured for easy and quiet movement on support surface S from one position to another.

Base 14 of desk 12 includes a front transverse base member 20 and a rear transverse base member 22. A central axial base member 24 extends between and interconnects front transverse base member 20 and rear transverse base member 22. In the illustrated embodiment, front transverse base member 20 is in the form of a straight tubular member, although it is understood that front transverse base member 20 may be formed of any other satisfactory structural member having any other desired shape. Rear transverse base member 22 is also in the form of a tubular member. In the illustrated embodiment, rear transverse base member 22 has a U-shaped configuration, including a central bight section 26 and outwardly and rearwardly angled side sections 28. Again, it is understood that rear transverse base member 22 may have any other satisfactory structural cross section, and may be formed in any desired shape. The U-shaped configuration of rear transverse base member 22 provides both front-rear and side-to-side stability of base 14. Central axial base member 24 is connected at the center of front transverse base member 20 and at the center of bight section 26 of rear transverse base member 22. In the illustrated embodiment, central axial base member 24 is in the form of a tubular member having an elliptical cross section, although it is understood that central axial base member 24 may have any other satisfactory structural cross section and may be formed in any desired shape. Representatively, the ends of central axial base member 24 may be secured to front transverse base member 20 and rear transverse base member 22 in any satisfactory manner, such as by welding.

End-type casters 30 are secured to the ends of front transverse base member 20. Each caster 30 includes a cylindrical body 32 that defines a cavity or recess within which one of the ends of front transverse base member 20 is received, in combination with a roller 34 that extends below the lower extent of cylindrical body 32 for engagement with support surface S. Casters of this type are known in the art, and a representative construction is illustrated in Bosman U.S. Pat. No. D471,791, the disclosure of which is hereby incorporated by reference.

Figure 6:
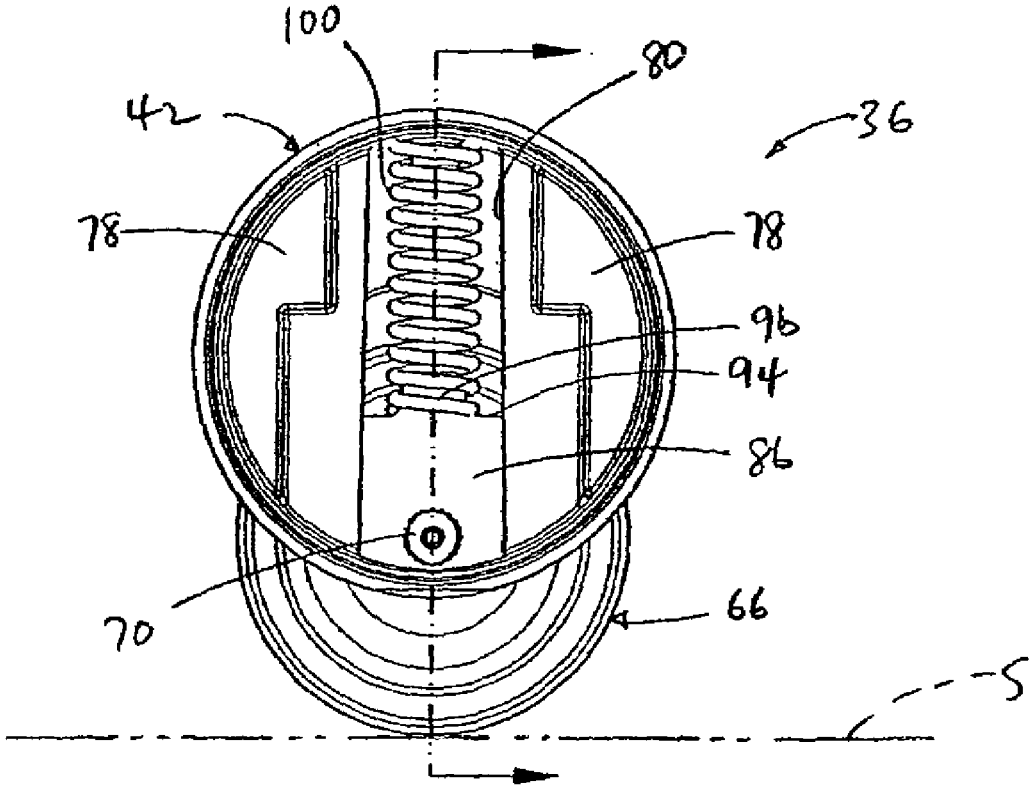
FIG. 6 is a section view taken along line 6-6 of FIG. 1, showing a locking caster incorporated into the student desk in accordance with the present invention.
Figure 7:
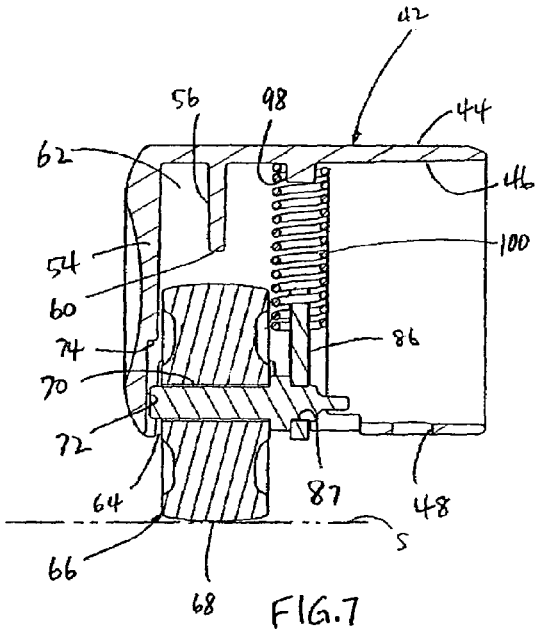
FIG. 7 is a section view taken along line 7-7 of FIG. 6, showing the locking caster of FIG. 6 in an unlocked position.
Figure 8:
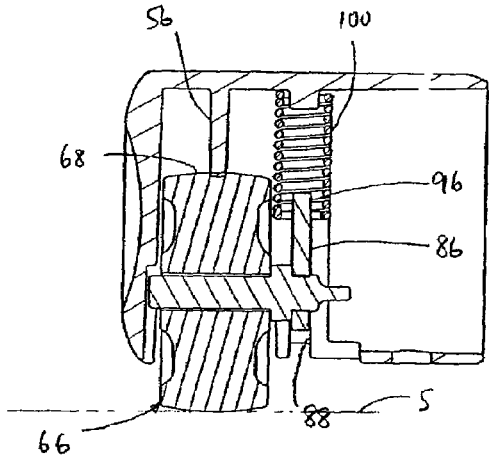
FIG. 8 is a section view similar to FIG. 7, showing the locking caster in a locked position.

Locking casters 36 are secured to the ends of rear transverse base member 22. Each locking caster 36 has a construction as shown in FIGS. 6-8. Each locking caster 36 includes a housing 42, which includes a generally tubular mounting section 44 configured to receive and engage the end portion of rear transverse base member 22. Tubular mounting section 44 includes an annular wall that defines a laterally open passage 46, which forms a portion of the interior of housing 42. Passage 46 is configured so as to enable an end portion of rear transverse base member 22 to be received and engaged within passage 46. A threaded opening 48 is formed in the lower area of each support member end portion. Threaded opening 48 is configured to receive the threads of a fastener, such as a screw or the like, which extends through an opening in the lower area of tubular mounting section 44. Engagement of the threads of the screw within threaded opening 48 functions to selectively mount locking caster 36 to the end portion of rear transverse base member 22.

Housing 42 further includes an end wall 54, and includes a vertical brake wall 56 that extends inwardly from the inner surface of tubular mounting section 44. The inner surface brake wall 56 defines an arcuate engagement surface 60. An inner portion of the interior of housing 42, shown at 62, is defined adjacent brake wall 56.

The end portion of housing 42 includes a downwardly facing opening 64. A wheel or roller member 66 is disposed within the end portion of the interior of housing 42, and defines a lower portion that extends through opening 64 so that wheel or roller member 66 engages a support surface S. Wheel 66 defines a circular outer surface 68, and includes a central transverse passage through which an axle 70 extends. The outer end portion of axle 70 extends outwardly from the outer side surface of wheel 68, and is received within a recess 72 formed in the inner surface of the lower section 56 of housing end wall 54. Recess 72 has a width slightly greater than, and in closed tolerance to, the diameter of axle 70, and defines a downwardly open vertically extending slot having an upper edge 74.

Housing 42 further includes a pair of guide walls 78 that separate passage 46 of tubular mounting section 44 and inner portion 62 of the interior of housing 42. Guide walls 78 define a vertical slot 80. Guide wall slot 80 is in lateral alignment with recess 72, and the inner end portion of axle 70 extends through guide wall slot 80.

The inner end portion of axle 70, which extends through guide wall slot 80 and inwardly of guide walls 78, is rigidly mounted to an axle carrier 86. Axle carrier 86 includes an opening 87 which is configured to receive the inner end portion of axle 70. Axle carrier 86 and axle 70 may be rigidly interconnected in any satisfactory manner, such as by an expansion-type connection, welding, or in any other manner. Axle carrier 86 is a generally planar member, and includes side edge areas that are received within facing guide slots, such as shown at 88, defined by guide walls 78.

Axle carrier 86 further an upper edge 94 located between the side edge areas. A retainer tab 96 extends upwardly from upper edge 94, so that upper edge 94 defines a pair of upwardly facing shoulders located one on either side of retainer tab 96.

The inner surface of tubular mounting section 44 of housing 42 is formed so as to define an inwardly extending mounting boss 98 located outwardly of guide walls 78. A biasing member, in the form of a spring 100, bears between axle carrier 86 and the inner surface of the wall of mounting section 44 adjacent mounting boss 98. Spring 100 is in the form of a coil spring having an internal passage, and mounting boss 98 extends into the upper area of spring 100. Retainer tab 96 of axle carrier 86 extends into the lower area of the passage of spring 100. With this construction, the shoulders defined by the areas of upper edge 94 adjacent retainer tab 96 engage the lower extent of spring 100. Spring 100 thus biases housing 42 upwardly relative to axle carrier 86, toward a position as shown in FIGS. 6 and 7, in which axle 70 is in a lowered position.

In operation, each locking caster 36 functions as follows to selectively fix student desk 12 in position. When seat section 16 of student desk 12 is unoccupied, the biasing force of spring 100 urges housing 42 upwardly relative to axle carrier 86 to the position as shown in FIGS. 6 and 7, and as described immediately above. The upward force of spring 100 applies an upward force to the support member of student desk 12 that is mounted to locking caster 36, to lift the rearward area if student desk 12. In this position, engagement surface 60 of brake wall 54 is moved away from wheel outer surface 68, such that wheel 66 is freely rotatable within the interior of housing 42. Wheel 66 thus enables student desk 12 to be moved on support surface S to a desired position.

When a user is seated in chair section 12 of student desk 12, the weight of the user applies a downward force to base assembly 28 through seat support pedestal 22. The downward force on base assembly 28 in turn applies a downward force to each locking caster 36, which overcomes the upward biasing force of each spring 100. For each locking caster 36, the downward force functions to move the housing 42 downwardly against the biasing force of each spring 100. Such downward movement of the housing 42 moves the engagement surface 60 downwardly toward and into engagement with roller outer surface 68, as shown in FIG. 4. Such downward movement of housing 42 relative to its associated wheel 66 is accommodated by recess 72 and slot 80, which enable axle 70 to remain stationary by virtue of engagement of outer surface 68 of wheel 66 with support surface S.

During movement of housing 42 relative to axle 70, wheel 66 is maintained in an upright position by engagement of the end portion of axle 70 within recess 72 and engagement of axle carrier 86 within the guide slots 88 defined by guide walls 78. With this construction, engagement of roller outer surface 68 by engagement surface 60 prevents rotation of wheel 66 until the load on seat 16 of student desk 12 is relieved.

Locking casters 36 are oriented so that the rollers 66 of locking casters 36 are oriented transversely relative to the orientation of rollers 34 of casters 30. This orientation of locking caster wheels 66 facilitates sideways movement of student desk 12 when desk 12 is being moved, and facilitates prevention of forward-rearward movement of student desk 12 when the user is seated in desk 12.

Referring to FIGS. 1-5, a worksurface support member 116 extends upwardly from the forward area of base 14, and a seat support member 118 extends upwardly from the rearward area of base 14. In the illustrated embodiment, both worksurface support member 116 and seat support member 118 are in the form of upstanding vertically oriented tubular members, each of which is mounted at its lower end to central axial base member 24. It is understood, however, that the support members may have any other satisfactory cross section and may be mounted to any other area of base 14.

A worksurface mounting plate 120 is secured to the underside of worksurface 18. A worksurface mounting stem 122 depends from worksurface mounting plate 120, and includes a series of vertically spaced transverse openings 124. Worksurface support member 116 includes a pair of aligned transverse openings 126, and a retainer member 128, such as a pin, is adapted for insertion through support member openings 126 and a selected set of stem openings 124, to secure worksurface 18 to worksurface support member 116 in a desired vertical position. In this manner, the height of worksurface 18 relative to support surface S can be selected and adjusted, according to the desired height for the user of desk 12.

Seat 16 of desk 12 includes a generally horizontal seat section 132 and an upright back section 134. In the illustrated embodiment, seat section 132 and back section 134 are formed integrally, although it is understood that seat section 132 and back section 134 may be formed separately and connected together in a known manner. Back section 134 includes an opening 136 toward its upper end.

A seat mount 138 is secured to the underside of seat section 132 of seat 16. Seat mount 138 includes a peripheral flange 140, which includes openings that enable connection of seat mount 138 to seat section 132 via fasteners 142, which may be in the form of screws, rivets or the like. Seat mount 138 further includes a peripheral side wall 144 and a bottom wall 146.

Seat mount 138 is secured to seat support member 118 via a height adjustment cylinder assembly 148, which includes a cylinder 150 and an extendable and retractable rod 152. The upper end of cylinder 150 is mounted to bottom wall 146 of seat mount 138, and the lower end of rod 152 bears against an internal upwardly facing surface within the interior of seat support member 118, which may be the upper surface of central axial base member 24. A sleeve or adapter 154 is engaged with the upper end of seat support member 118, and defines a passage 156 within which cylinder 150 of cylinder assembly 148 is received. Adapter 154 is configured to provide a tight and secure fit of cylinder assembly 148 within the internal passage defined by seat support member 118.

A height adjustment actuator 158 is connected to seat mount 138. Actuator 158 is pivotably mounted to side wall 144 of seat mount 138 in a known manner, and includes an external paddle 160 which is adapted for manual engagement by a user, and an internal inner end 162 that overlies an actuator button at the upper end of cylinder 150.

In operation, the height of seat 16 relative to support surface S can be adjusted by lifting outer paddle section 158 upwardly so as to depress the button at the end of cylinder 150 while the user relieves his or her weight on seat 16. Under a biasing force applied by an internal spring associated with cylinder assembly 148, cylinder 150 is lifted upwardly so as to raise seat 16. The user can lower seat 16 by lifting upwardly on outer paddle section 160 of actuator 158 and applying his or her weight to seat 16, to overcome the biasing force of the internal spring of cylinder assembly 148, to lower seat 16 to a desired elevation. When seat 16 is in the desired elevation, the user releases outer paddle section 160 of actuator 158 to release actuation of the button of cylinder assembly 148, which functions to fix the length of cylinder assembly 148 and to thereby maintain the height of seat 16 in the desired elevation.

When it is desired to move desk 12 from one location to another, seat 16 is vacated and the user grasps opening 136 in back section 134 of seat 16. Locking casters 36 are in the unlocked position, which provides free rotation of the locking caster rollers on support surface S. Front casters 30 and rear locking casters 36 thus provide easy and quiet movement of desk 12 on support surface S to a desired position within a classroom. Very little force is required to move desk 12 from one location to another, which enables any type of user to quickly and easily reposition the desk 12 to a desired location. Desk 12 can thus be moved to different positions by children or by teachers or other staff members of varying physical capabilities. When a user is seated in desk 12, however, the position of desk 12 within the classroom is fixed due to operation of the locking casters 36.

Desk 12 has a relatively small number of components, which eases manufacture and assembly. The structure of desk 12 is such as to provide a maximum amount of leg room below worksurface 18 due to the low profile of base 14, while providing a significant degree of stability both in a front-rear direction and in a side-to-side direction. These advantages, coupled with the ease of movement of desk 12 from one location to another, provides a desk that is affordable, versatile and extremely easy to use and reposition, which facilitates collaborative teaming and room reconfiguration.

While the invention has been shown and described with respect to a specific embodiment, it is understood that various alternatives and modifications are possible and are contemplated as being within the scope of the present invention. For example, and without limitation, the base, seat and worksurface components of the desk may take many different forms than those illustrated, while providing a similar overall construction of the desk. The worksurface may have any desired shape or size, and the desk seat may have any desired configuration or construction. The base components may be formed of various materials having various cross sections, and the specific shapes and configurations of the base components may vary. The same is true for the seat support and worksurface support components by which the seat and worksurface, respectively, are mounted to the base. In addition, while the desk has been shown and described as having non-locking casters at the front and locking casters at the rear, it is also contemplated that the desk may have locking casters at both the front and the rear, or may have non-locking casters so that the desk can be moved to various locations even when occupied.

Various alternatives and embodiments are contemplated as being within the scope of the following claims particularly pointing out and distinctly claiming the subject matter regarded as the invention.

I claim:

1. A mobile desk adapted to be supported by a support surface such as a floor, comprising:

a base including a front transverse base member, a rear transverse base member, and a central axial base member extending between and interconnecting the front and rear transverse base members, wherein the front transverse base member, the rear transverse base member and the central axial base member lie in a common plane oriented parallel to the support surface, wherein the rear transverse base member includes a central section that is interconnected with the central axial base member, and a pair of end sections that extend rearwardly and laterally relative to the central section, wherein each end section terminates in an outer end;

a roller arrangement on the base, wherein the roller arrangement includes a pair of laterally spaced fixed-position front rollers secured to the front transverse base member on opposite sides of the central axial base member, and a pair of laterally spaced fixed position rear rollers secured to the rear transverse base member on opposite sides of the central axial base member, wherein the front and rear rollers engage the support surface;

wherein the fixed-position front rollers are oriented generally parallel to the central axial base member and perpendicular to the front transverse base member so as to guide forward-rearward movement of the mobile desk on the support surface, and wherein the fixed-position rear rollers are oriented generally perpendicular to the central axial base member and parallel to the central section of the rear transverse base member so as to guide lateral movement of the mobile desk on the support surface an upwardly extending seat support member defining a lower end secured to the base;

an upwardly extending worksurface support member defining a lower end secured to the base forwardly of the seat support member;

a seat secured to and supported above the base by the seat support member, wherein the seat includes a seat portion and a back portion, wherein the rear rollers are interconnected with the end sections of the rear transverse base member and are located toward the outer ends of the end sections, and are positioned so as to be located outwardly and rearwardly relative to the seat;

a handle arrangement associated with the back portion of the seat;

a worksurface secured to and supported above the base by the worksurface support member;

wherein, upon application of an upward force on the handle arrangement by a user, the user is able to lift the rear rollers off the support surface so as to enable axial movement of the mobile desk on the support surface using the front rollers, and upon application of a lateral force on the handle by a user, the user is able to move the mobile desk laterally on the support surface by lateral movement of the rear rollers and pivoting movement of the front rollers;

wherein the front transverse base member defines spaced apart ends, and wherein the rollers are incorporated in end-type casters, each of which comprises a tubular body member positioned over one of the outwardly facing ends of one of the base members, and a roller member carried by the tubular body member; and wherein the casters interconnected with the rear base member are configured to prevent rotation of wheels associated with the rear casters in response to the weight of a user when the seat is occupied by the user, and to allow rotation of the rear caster wheels when the seat is unoccupied.

2. The mobile desk of claim 1, wherein the handle arrangement comprises an opening in an upper area of the back section, wherein the opening is configured to receive a user's fingers to enable the user to grasp the back section of the seat for moving the desk on the support surface.

3. The mobile desk of claim 1, further comprising a seat height adjustment arrangement interposed between the seat and the seat support member, and a worksurface height adjustment arrangement interposed between the worksurface and the worksurface support member.

4. The mobile desk of claim 3, wherein the seat height adjustment arrangement comprises a cylinder assembly including a cylinder and an outwardly biased extendible and retractable rod, and a seat height actuator interconnected with the seat for enabling the rod to be selectively extended and retracted to vary the height of the seat.

5. The mobile desk of claim 3, wherein the worksurface support member comprises a tubular member defining an internal passage, and wherein the worksurface is mounted to the worksurface support member via a stem depending from the worksurface and received within the internal passage of the worksurface support member, and wherein the worksurface height adjustment arrangement includes a variable position engagement arrangement interposed between the stem and the worksurface support member.

* * * * *